US005365839A

United States Patent [19]

Yoshino et al.

[11] Patent Number: 5,365,839

[45] Date of Patent: Nov. 22, 1994

[54] SHUTTLE PRINTER

[75] Inventors: Satoshi Yoshino; Keiko Nojiri, both of Kanagawa, Japan

[73] Assignee: Fujitsu Limited, Kawasaki, Japan

[21] Appl. No.: 168,266

[22] Filed: Dec. 14, 1993

Related U.S. Application Data

[63] Continuation of Ser. No. 91,651, Jul. 14, 1993.

[30] Foreign Application Priority Data

Jul. 24, 1992 [JP] Japan ..... 4-202551

[51] Int. Cl.[5] ..... B41J 7/70; B41J 19/00

[52] U.S. Cl. ..... 101/93.04; 101/93.05; 400/322; 400/124.08; 318/135; 310/12

[58] Field of Search ..... 400/322, 157.2, 124, 400/121, 323, 320; 101/93.04, 93.05, 93.29, 93.09, 93.48; 318/135, 687; 310/12

[56] References Cited

U.S. PATENT DOCUMENTS

| | | | |
|---|---|---|---|
| 3,941,051 | 3/1976 | Barrus et al. | 101/93.04 |
| 4,149,808 | 4/1979 | Matthias et al. | 400/322 |
| 4,151,447 | 4/1979 | von der Heide et al. | 318/135 |
| 4,306,497 | 12/1981 | Hamada | 101/93.05 |
| 4,359,289 | 11/1982 | Barrus et al. | 400/322 |
| 4,543,884 | 10/1985 | Kikuchi et al. | 101/93.04 |
| 4,572,685 | 2/1986 | Matsumoto et al. | 400/320 |
| 4,637,307 | 1/1987 | Miller | 101/93.04 |
| 4,686,899 | 8/1987 | Puchegger | 400/121 |
| 4,839,543 | 6/1989 | Beakley et al. | 310/12 |
| 4,921,365 | 5/1990 | Sanders, Jr. et al. | 400/322 |

FOREIGN PATENT DOCUMENTS

| | | | |
|---|---|---|---|
| 0027358 | 3/1981 | Japan | 101/93.04 |
| 0016159 | 1/1982 | Japan | 101/93.04 |
| 0163673 | 9/1983 | Japan | 101/93.04 |
| 0169257 | 7/1986 | Japan | 101/93.04 |
| 0094349 | 4/1987 | Japan | 101/93.04 |

*Primary Examiner*—Eugene H. Eickholt

[57] ABSTRACT

A shuttle printer having a print shuttle unit capable of reciprocating with a print head mounted thereon, and a balance shuttle unit capable of reciprocating to generate counterforce to momentum of the print shuttle unit. The shuttle printer includes a device for driving the print shuttle unit to reciprocate, and a device for driving the balance shuttle unit to reciprocate. The shuttle printer further includes a device for detecting the position of the print shuttle unit, and a device for synchronously controlling the two driving devices in response to a result of detection by the print shuttle unit position detecting device.

26 Claims, 12 Drawing Sheets

SHUTTLE PRINTER

This is a continuation, of patent application Ser. No. 08/091,651, filed Jul. 14, 1993.

BACKGROUND OF THE INVENTION

1. Field of the Invention

The present invention relates to a shuttle printer which performs line printing by reciprocating a print shuttle equipped with a multiplicity of print heads.

Recently, printers have been demanded to be capable of printing graphic information in addition to characters and of effecting high-speed printing. Therefore, dot printers are widely used. Among them, line printers are effective for high-speed printing. However, it is difficult from the viewpoint of mounting to provide a row of dot print elements for one line horizontally. Dissipation of heat also gives rise to a problem.

Under these circumstances, a shuttle printer has been developed in which a multiplicity of print heads, each having 24 pins, for example, are mounted on a shuttle, and this shuttle is reciprocated through a distance corresponding to an area assigned to each print head, thereby effecting line printing.

2. Description of the Related Art

If such a print shuttle is merely reciprocated to effect printing, vibration is generated in the printer due to momentum of the print shuttle produced according to the mass and velocity thereof. Accordingly, some measure must be taken to prevent generation of such vibration.

In one approach to this problem, a counterweight (balance unit) for canceling the momentum of the print shuttle is connected to it through a link mechanism so that as the print shuttle is reciprocated by a motor, the counterweight moves in linked relation to the reciprocating motion of the print shuttle in a direction reverse to the direction of movement of the print shuttle.

The motion of the counterweight gives counterforce to the momentum of the print shuttle so as to cancel it. Thus, vibration of the printer is prevented.

However, the motor, which is used to drive the print shuttle, must drive not only the print shuttle but also the counterweight together with it through the link mechanism. Accordingly, the load applied to the motor is so heavy that it is difficult to drive the print shuttle at high speed.

If the motor is increased in size in order to effect high-speed driving, the overall size of the printer increases, and the production cost rises.

SUMMARY OF THE INVENTION

An object of the present invention is to provide a shuttle printer capable of high-speed printing by reciprocating a print shuttle at high speed with a relatively small driving device.

Other objects and advantages of the present invention will become apparent from the following detailed description of illustrated embodiments of the invention.

According to the present invention, there is provided a shuttle printer having a print shuttle unit capable of reciprocating with a print head mounted thereon, and a balance shuttle unit capable of reciprocating to generate counterforce to momentum of the print shuttle unit. The shuttle printer includes a device for driving the print shuttle unit to reciprocate, and a device for driving the balance shuttle unit to reciprocate. The shuttle printer further includes a device for detecting the position of the print shuttle unit, and a device for synchronously controlling the two driving devices in response to a result of detection by the print shuttle unit position detecting device.

BRIEF DESCRIPTION OF THE DRAWINGS

The present invention may be more fully understood from the description of preferred embodiments of the invention set forth below, together with the accompanying drawings, in which.

DESCRIPTION OF THE PREFERRED EMBODIMENTS

Embodiments of the present invention will be described below with reference to the accompanying drawings.

Figure 1:
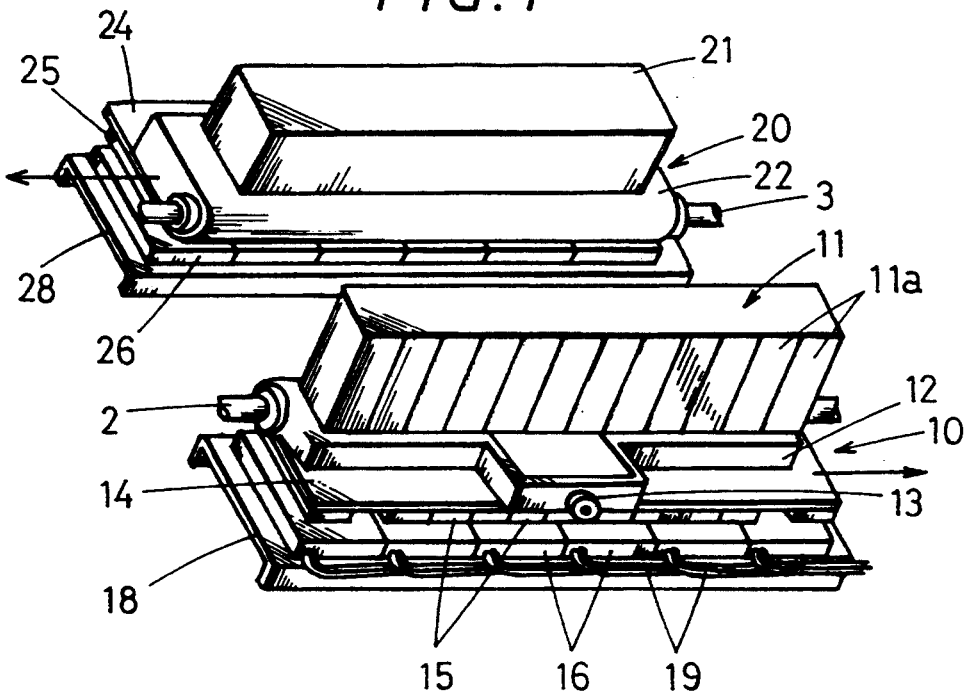
FIG. 1 is a fragmentary perspective view of a shuttle unit in a first embodiment of the present invention.
Figure 2:
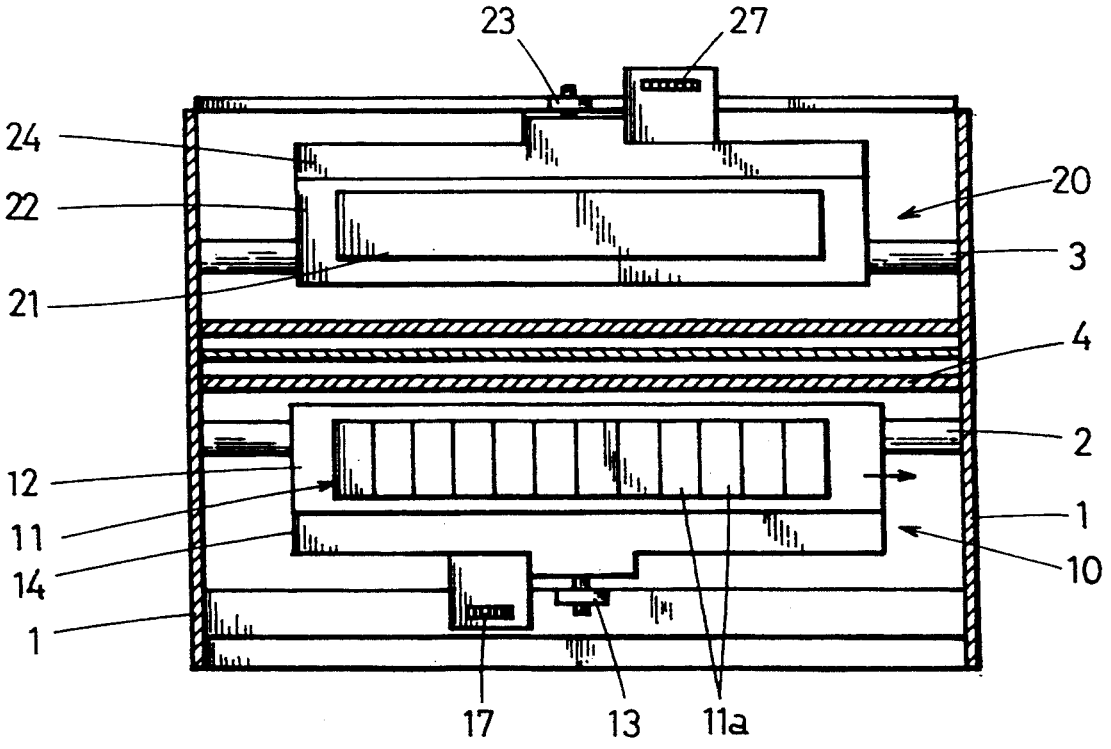
FIG. 2 is a plan view of the shuttle unit in the first embodiment of the present invention.
Figure 3:
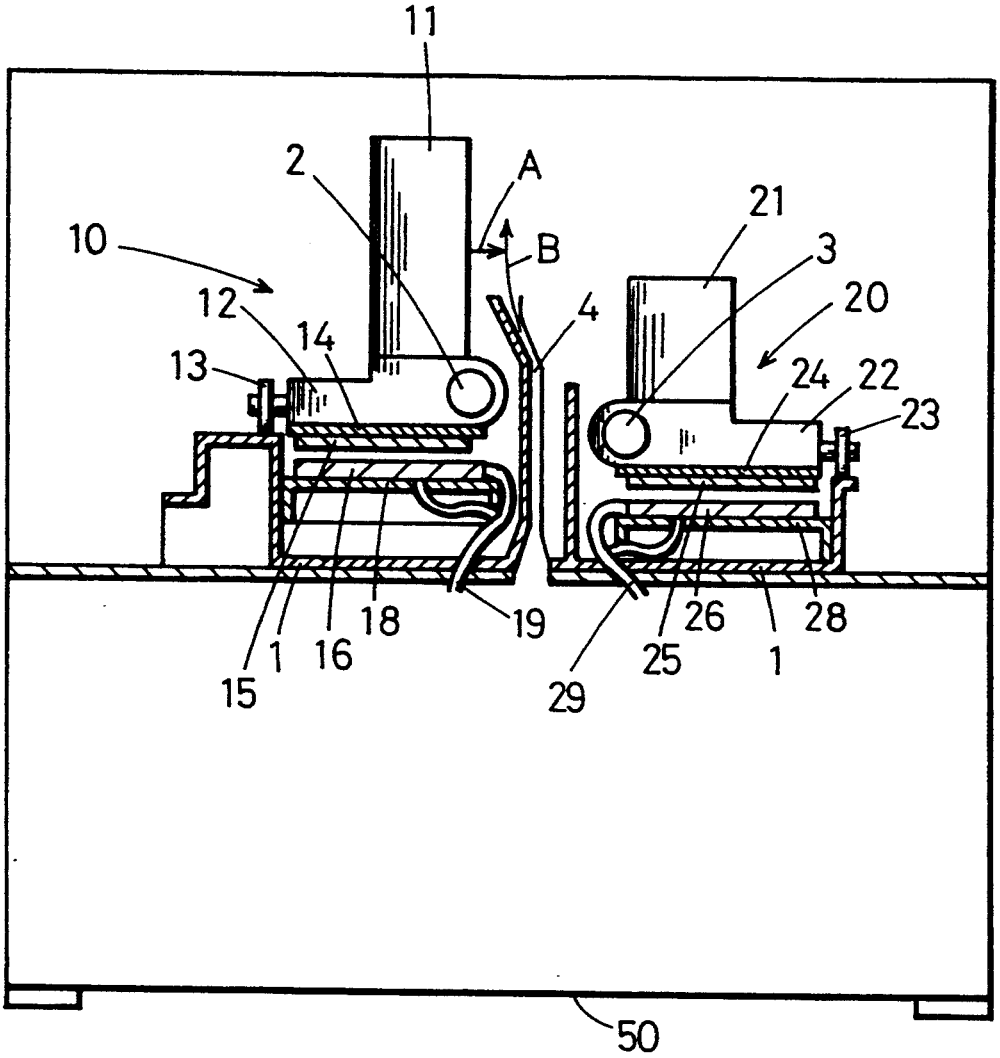
FIG. 3 is a sectional side view of the shuttle unit in the first embodiment of the present invention.

FIGS. 1 to 3 show in combination one embodiment in which the present invention is applied to a line printer, FIG. 1 is a perspective view of an essential part of the line printer which includes a print shuttle unit and a balance shuttle unit. FIGS. 2 and 3 are a plan view and a sectional side view of the same part of the line printer.

A base frame 1 is secured to a casing 50. A pair of parallel stay shafts 2 and 3 extend horizontally and are each secured at both ends thereof to the base frame 1. It should be noted that in FIG. 1 illustration of the casing 50 and the base frame 1 is omitted, and in FIG. 2 illustration of the casing 50 is omitted.

A print shuttle 12 is slidably fitted on the first stay shaft 2, which is disposed in the central portion of the base frame 1. The print shuttle 12 is equipped with a print head 11 comprising a row of a multiplicity of print pins. The print shuttle 12 is supported by the first stay shaft 2 and a roller 13 capable of traveling on the base frame 1.

Figure 5:
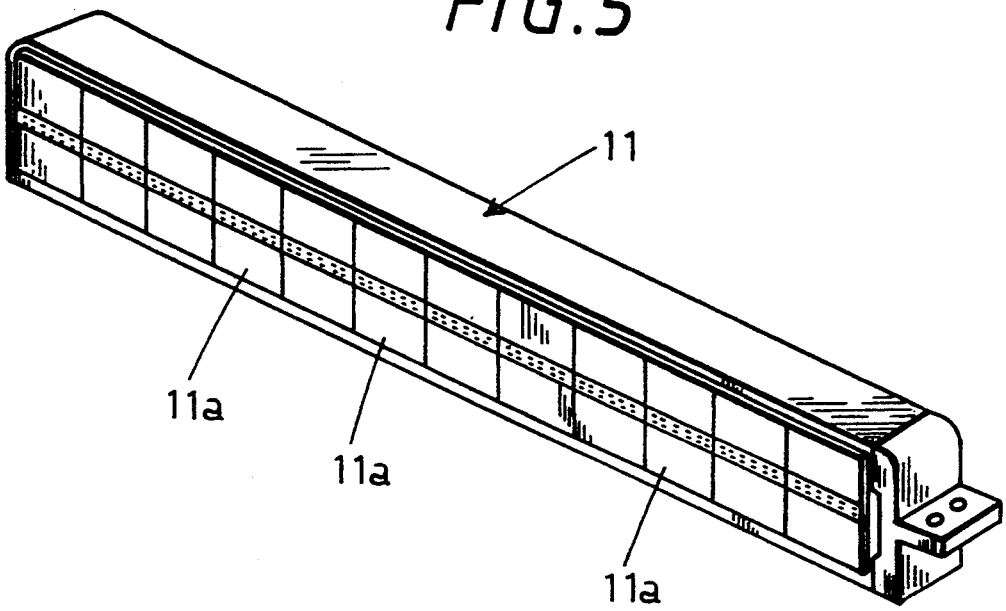
FIG. 5 is a perspective view of a print head in the first embodiment of the present invention.
Figure 6:
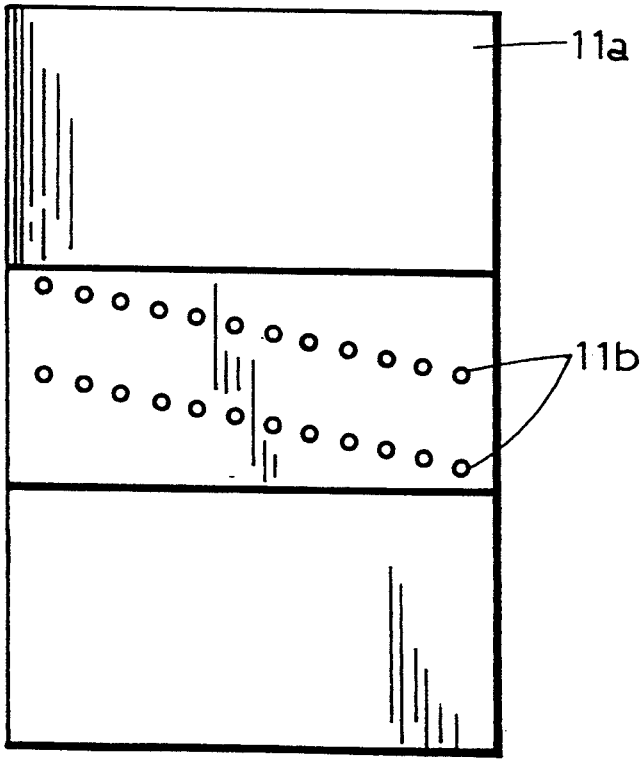
FIG. 6 is a front view of a print head assembly in the first embodiment of the present invention.

The print head 11 is of the electromagnetic release type, for example. As shown in FIG. 5, the print head 11 comprises a row of 12 (for example) print head assemblies 11*a* of 24-pin type arranged horizontally. Each print head assembly 11*a* is formed from 4 sets of 6 print elements which are respectively arranged in front upper, front lower, rear upper and rear lower stages in such a manner that the two sets of print elements in the front and rear upper stages are symmetric with respect to those in the front and rear lower stages. The print elements perform printing in units of dots by print pins. In each print head assembly 11*a*, wires 11*b* of the 24 pins are obliquely arranged in two groups of 12 pins, as shown in FIG. 6

When the print head 11 is driven, the distal ends of the print pins project in the direction of the arrow A, shown in FIG. 3, thereby striking printing paper, which is fed in the direction of the arrow B through a paper feed passage 4, through an ink ribbon (not shown). Thus, impact dot printing is carried out. This printer performs impact dot printing by reciprocating the print shuttle unit 10 through a distance corresponding to the width of the print head assembly 11*a*

A yoke 14, which is a planar iron plate, is attached to the bottom of the print shuttle 12. A row of a plurality of rectangular plate-shaped permanent magnets 15 are disposed on the lower surface of the yoke 14 in a direction parallel to the axis of the first stay shaft 2. The permanent magnets 15 are each magnetized in the direction of the thickness thereof. That is, each permanent magnet 15 has two magnetic poles at the upper and lower end faces thereof.

The permanent magnets 15 are formed by using rare-earth magnets, which have a strong magnetic property, for example, samarium-cobalt magnets. Accordingly, the permanent magnets 15 are thin and light in weight in comparison to ferrite magnets or others (e.g., the thickness and weight are each 1/5 of that in the case of the latter).

Thus, the print shuttle 12, and the print head 11, the yoke 14 and the permanent magnets 15, which are attached to the print shuttle 12, form a print shuttle unit 10 which is movable along the first stay shaft 2.

A row of electromagnetic coils 16 are secured to a coil base 18, which is formed from an iron plate secured to the base frame 1, so that the electromagnetic coils 16 face the permanent magnets 15 of the print shuttle unit 10 across a slight gap.

Thus, the permanent magnets 15 and the electromagnetic coils 16 form a linear motor (first linear motor) for driving the print shuttle unit 10. Lead wires 19 are used to feed electric power to the electromagnetic coils 16.

Figure 4:
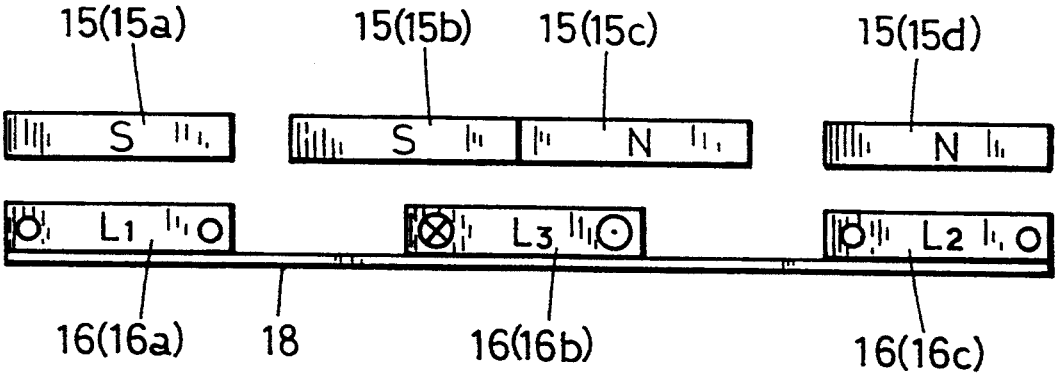
FIG. 4 is a front view of a linear motor in the first embodiment of the present invention.

In this linear motor, as shown in FIG. 4, the permanent magnets 15 are divided into magnets 15*a* and 15*d* for contsant-speed control and magnets 15*b* and 15*c* for reversing, and the electromagnetic coils 16 are also divided into coils 16*a* (L1) and 16*c* (L2) for constant-speed control and a coil 16*b* (L3) for reversing, When the reversing coil 16*b* is driven, the coil 16*b* moves relative to the yoke 14 as far as the center of the pair of reversing magnets 15*b* and 15*c* to effect a reversing operation. When current is passed through the constant-speed control coils 16*a* and 16*c* in the forward direction, the print shuttle unit 10 moves rightward. When current is passed through the coils 16*a* and 16*c* backward, the print shuttle unit 10 moves leftward.

In addition, a position detecting sensor 17 is provided, as shown in FIG. 2. The position detecting sensor 17 comprises slits formed in the yoke 14 of the print shuttle unit 10, and a transmissive photosensor that is attached to the base frame 1 so as to face the slits. In FIGS. 1 and 3, illustration of the position detecting sensor 17 is omitted.

The slits of the position detecting sensor 17 include a right-hand end slit, timing slits and a left-hand end slit, which are provided in the yoke 14. Thus, with regard to the print shuttle unit 10, a right-hand end detecting signal, a position signal, and a left-hand end detecting signal are output by the photosensor.

A balance shuttle 22, which is formed in the same way as the print shuttle 12, is slidably fitted on the second stay shaft 3, which is disposed parallel to the first stay shaft 2.

A counterweight 21 is mounted on the balance shuttle 22, and a yoke 24 is attached to the bottom of the balance shuttle 22. A row of permanent magnets 25, which are similar to the permanent magnets 15 of the print shuttle unit 10, are attached to the lower surface of the yoke 24.

A roller 23 is rotatably attached to the balance shuttle 22 so that the balance shuttle 22 travels on the base frame 1. The balance shuttle 22 is supported by the roller 23 and the second stay shaft 3.

Thus, a balance shuttle unit 20 is formed from the balance shuttle 22 and the counterweight 21, the yoke 24 and the permanent magnets 25, which are attached to the balance shuttle 22.

The constituent elements of the balance shuttle unit 20 can move as one unit in parallel to the print shuttle unit 10. The balance shuttle unit 20 is formed so that the overall weight thereof is approximately equal to that of the print shuttle unit 10.

A coil base 28 is secured to the base frame 1, and a row of electromagnetic coils 26, which are similar to the electromagnetic coils 16 shown in FIG. 4, are secured to the coil base 28 so as to face the row of permanent magnets 25 disposed on the balance shuttle 22 across a slight gap.

Thus, the permanent magnets 25 and the electromagnetic coils 26 form a linear motor (second linear motor) for driving the balance shuttle unit 20. Lead wires 29 are used to supply electric power to the electromagnetic coils 26.

By properly controlling the current passed through the electromagnetic coils 26, the balance shuttle unit 20 can be rectilinearly reciprocated at high speed along the second stay shaft 3.

In addition, the balance shuttle unit 20 is also provided with a position detecting sensor 27, which is similar to the position detecting sensor 17 of the print shuttle unit 10, to output a position signal.

Thus, when the print shuttle unit 10 is moved rightward, the balance shuttle unit 20 is moved leftward, whereas, when the print shuttle unit 10 is moved leftward, the balance shuttle unit 20 is moved rightward. In this way, the balance shuttle unit 20 generates counterforce to the momentum of the print shuttle unit 10 to cancel it, thereby preventing generation of vibration.

Thus, since the print shuttle unit 10 and the balance shuttle unit 20 are independently driven by the respective driving devices, the print shuttle unit 10 can be reciprocated at high speed with a relatively small motor without using a large motor. In addition, the use of linear motors as driving devices enables a reduction in the overall size of the printer.

Figure 7:
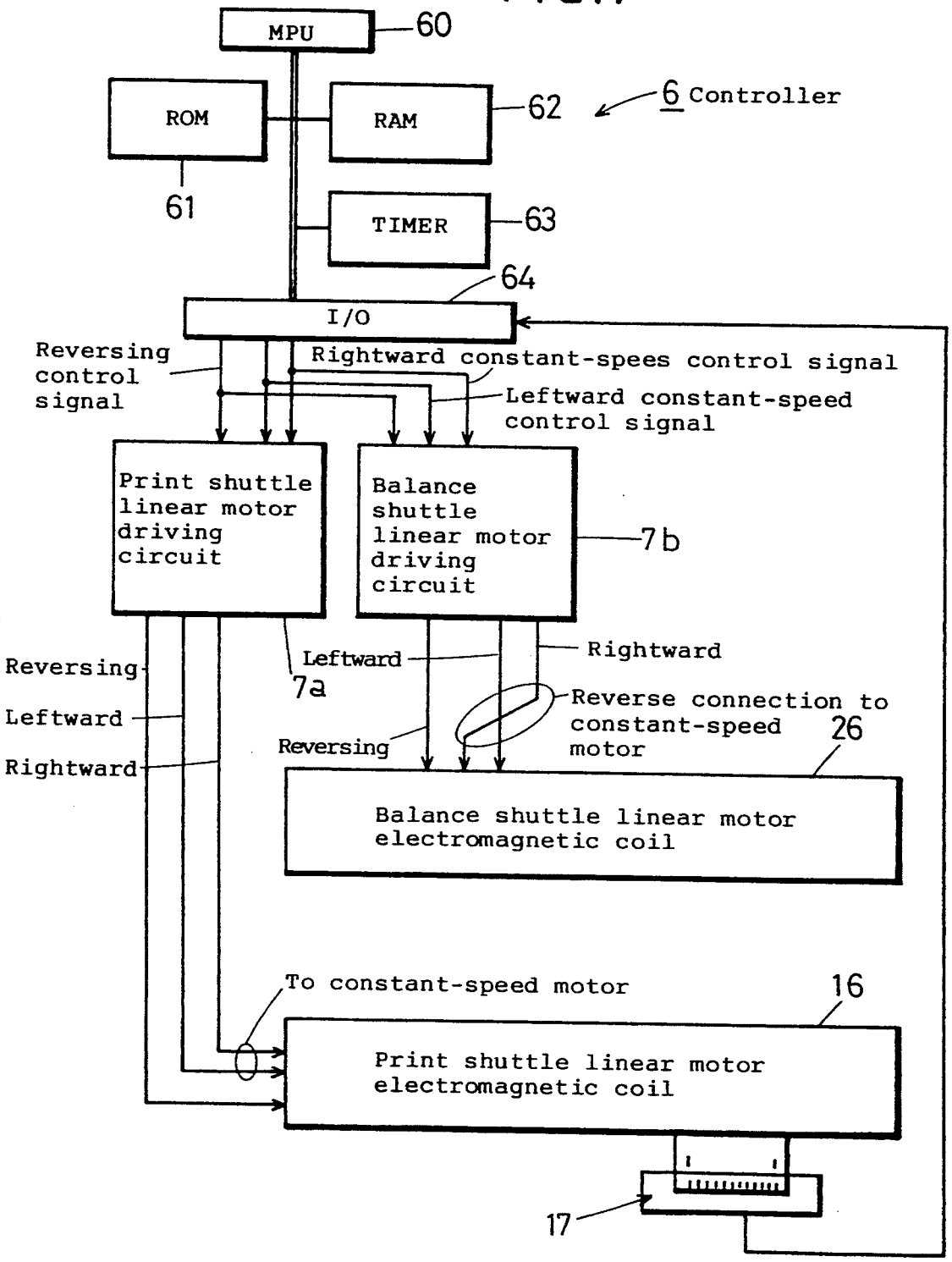
FIG. 7 is a circuit block diagram of the first embodiment of the present invention.

FIG. 7 shows the arrangement of a controller 6 for controlling the operations of the first linear motor (15 and 16) and the second linear motor (25 and 26). The controller 6 is provided with a microprocessor (MPU) 60, a read-only memory (ROM) 61 stored with a program, a random access memory (RAM) 62 for work, a timer circuit 63, and a input/output (I/O) port 64 which receives an output signal from the position detecting sensor 17 and outputs a reversing control signal, a leftward constant-speed control signal and a rightward constant-speed control signal.

A first linear motor driving circuit *7a* for the print shuttle unit 10 drives the electromagnetic coils 16 of the first linear motor. A second linear motor driving circuit *7b* for the balance shuttle unit 20 drives the electromagnetic coils 26 of the second linear motor. The second linear motor driving circuit *7b* is connected to the electromagnetic coils 26 so that the constant-speed motor part of the second linear motor is opposite in polarity to that of the first liner motor.

Figure 8:
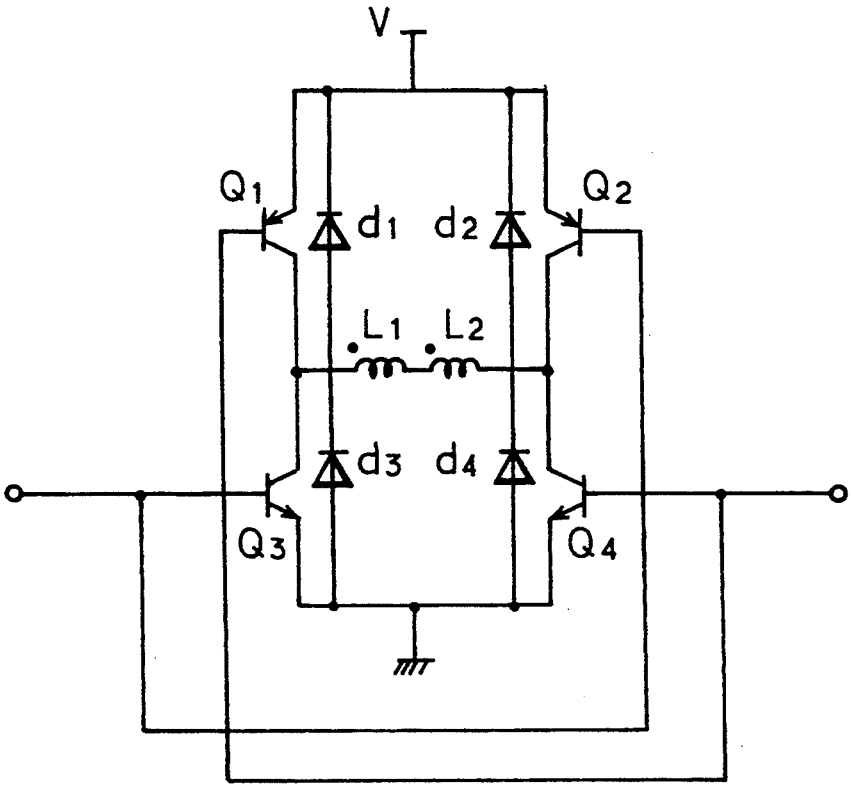
FIG. 8 is a diagram showing a constant-speed drive circuit in the first embodiment of the present invention.

FIG. 8 shows a constant-speed motor driving circuit used in each of the linear motor driving circuits *7a* and *7b*. The constant-speed motor driving circuit comprises an H-shaped bridge circuit in which transistors Q1 to Q4 are connected in an H-shape, and flyback diodes d1 to d4 are connected to the transistors Q1 to Q4, respectively.

More specifically, the constant-speed electromagnetic coils L1 and L2 are connected between the node of the series-connected transistors Q1 to Q3 and the node of the series-connected transistors Q2 to Q4. In response to a rightward driving signal, the transistors Q2 to Q3 turn on to pass current via the route: transistor Q2→coil L2→coil L1→transistor Q3. In response to a leftward driving signal, the transistors Q1 to Q4 turn on to pass current via the route: transistor Q1→coil L1→coil L2→transistor Q4. In this way, the print shuttle unit 10 and the balance shuttle unit 20 are each driven rightward and leftward.

Figure 9:
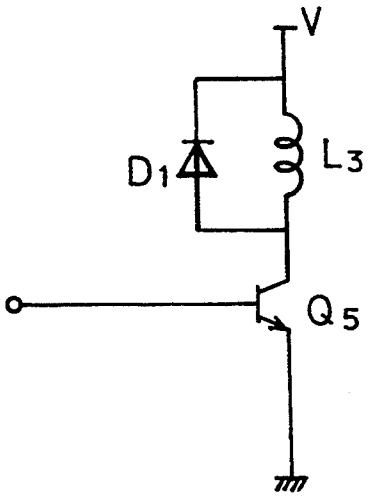
FIG. 9 is a diagram showing a reversing drive circuit in the first embodiment of the present invention.

FIG. 9 shows a reversing motor driving circuit used in each of the linear motor driving circuits *7a* and *7b*. The reversing motor driving circuit comprises a transistor Q5, and a parallel circuit of the reversing electromagnetic coil L3 and a flyback diode D1, which is provided on the collector side of the transistor Q5.

Accordingly, when a reversing driving signal is input to the base of the transistor Q5, current flows through the electromagnetic coil L3. Consequently, the coil L3 moves relative to the yoke 14 as far as the center of the permanent magnets 15*b* and 15*c*, as shown in FIG. 4.

it should be noted that the constant-speed electromagnetic coils L1 and L2 of the balance shuttle unit 20 may be wound in a direction reverse to the winding direction of those of the print shuttle unit 10 so that the balance shuttle unit 20 moves leftward in response to the rightward driving signal, and it moves rightward in response to the leftward driving signal.

Figure 10:
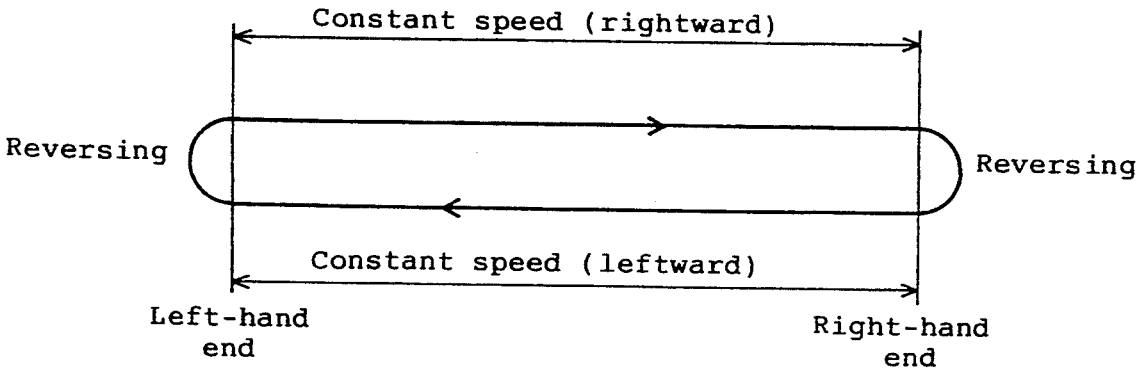
FIG. 10 is a schematic view showing the operation of the first embodiment of the present invention.
Figure 11:
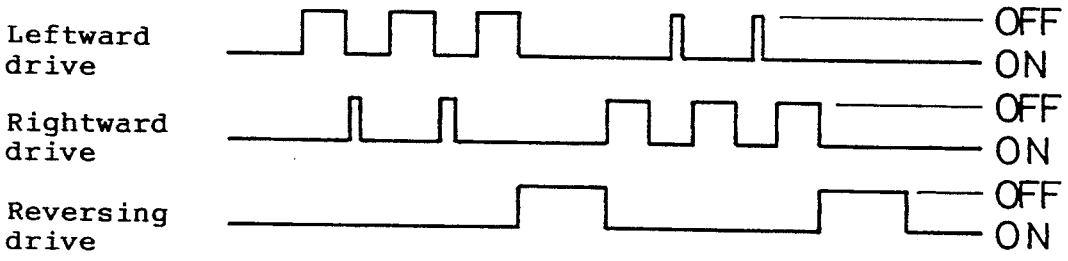
FIG. 11 is a timing chart of driving signals in the first embodiment of the present invention.

This operation is carried out as shown in FIGS. 10 and 11. That is, when the print shuttle unit 10 reaches the right-hand end during rightward constant-speed movement (leftward constant-speed movement of the balance shuttle unit 20), the reversing motor part 16*b* is driven to reverse the print shuttle unit 10. When the print shuttle unit 10 gets out of the reversing region, it is moved leftward at a constant speed (while the balance shuttle unit 20 is moved rightward at a constant speed). When the print shuttle unit 10 reaches the left-hand end, the reversing motor part 16*b* is driven to reverse the print shuttle unit 10. When the print shuttle unit 10 gets out of the reversing region, it is moved rightward at a constant speed again.

Figure 12:
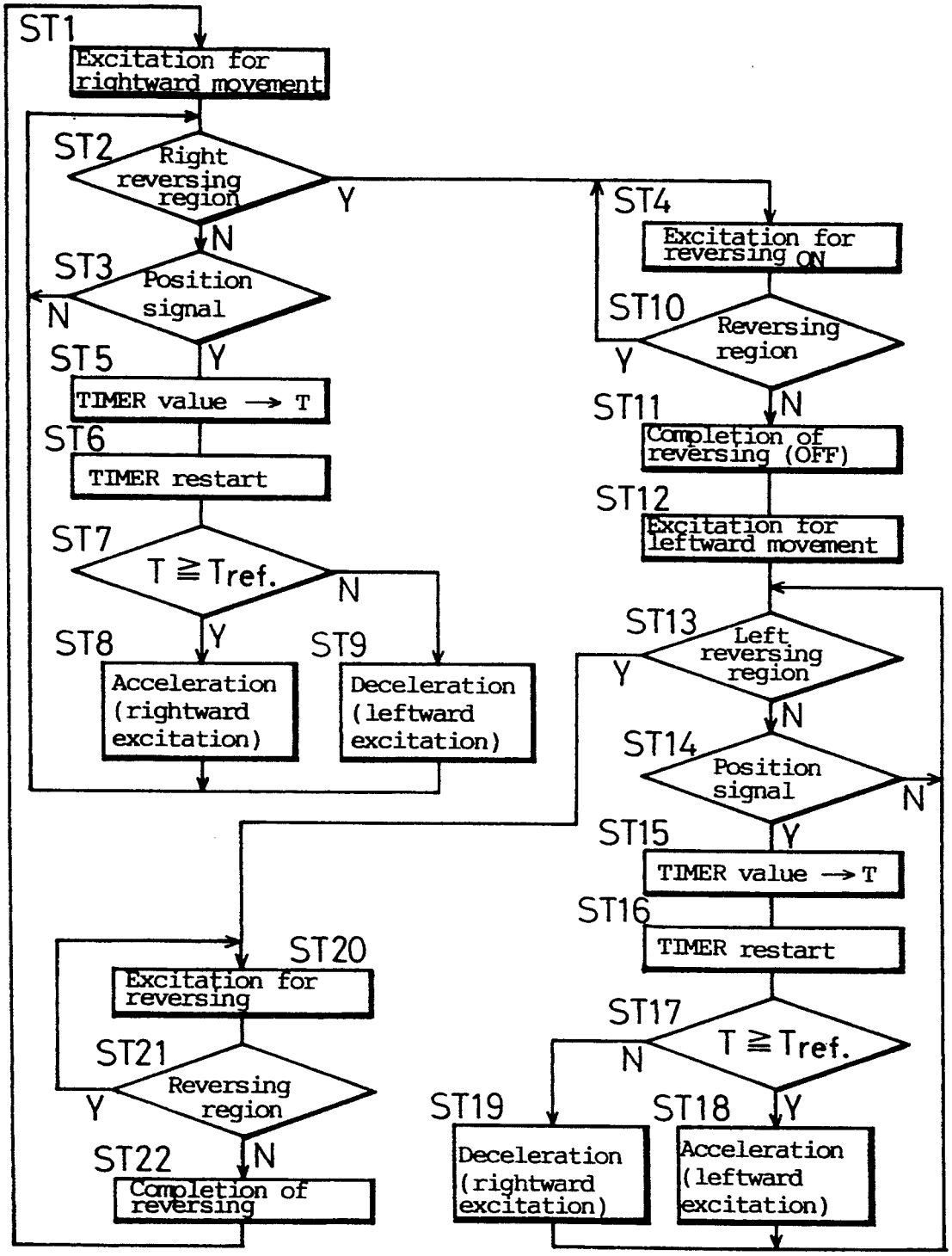
FIG. 12 is a flowchart showing control processing in the first embodiment of the present invention.

FIG. 12 is a flowchart showing control processing in the first embodiment of the present invention. Reference symbol ST denotes processing steps.

First, the microprocessor 60 outputs a rightward driving signal from the I/O port 64 at ST1 to drive the electromagnetic coils 16 and 26 of the linear motors through the driving circuits *7a* and *7b*, thereby moving the print shuttle unit 10 rightward and the balance shuttle unit 20 leftward.

Next, the microprocessor 60 checks at ST2 whether or not a right-hand end detecting signal, which represents detection of the right-hand end slit, has been output from the position detecting sensor 17. If YES, the microprocessor 60 proceeds to ST4 to effect reversing control.

If no right-hand end detecting signal is detected at ST2, the microprocessor 60 checks at ST3 whether or not a timing signal (position signal) from the position detecting sensor 17 has been detected. If NO, the process returns to ST2, whereas, if YES, the process shifts to constant-speed control. That is, the microprocessor 60 saves the measured value T of the timer circuit 63 at ST5 and restarts the timer circuit 63 at ST6 to commence measuring the interval of the position signal.

At ST7, the microprocessor 60 compares the measured interval value T of the saved position signal with a constant-speed reference interval value Tref. If $T \geqq Tref$, the speed is judged to be lower than the reference speed. Therefore, a rightward driving signal is output at ST8 to accelerate the shuttle units 10 and 20. If $T < Tref$, the speed is judged to be higher than the reference speed. Therefore, a leftward driving signal is output at ST9 to decelerate the shuttle units 10 and 20. Then, the process returns to ST2.

When the microprocessor 60 detects a right-hand end detecting signal at ST2, it turns on the reversing driving signal at ST4 to drive the reversing motor parts so as to reverse the shuttle units 10 and 20. As shown in FIG. 10, the microprocessor 60 checks again at ST10 whether or not a right-hand end detecting signal has been detected. If NO, the print shuttle unit 10 is judged to be within the reversing region. Accordingly, the process is repeated from ST4 to continue the reversing driving signal on. When a right-hand end detecting signal is detected, it is judged that the print shuttle unit 10 has got out of the reversing region. Therefore, the reversing driving signal is turned off at ST11, and the process proceeds to ST12 to effect leftward movement-control.

At ST12, the microprocessor 60 outputs a leftward driving signal from the I/O port 64 to drive the electromagnetic coils 16 and 26 of the linear motors through the driving circuits *7a* and *7b*, thereby moving the print shuttle unit 10 leftward and the balance shuttle unit 20 rightward.

Subsequently, the microprocessor 60 checks at ST13 whether or not a left-hand end detecting signal, which represents detection of the left-hand end slit, has been output from the position detecting sensor 17. If YES, the process proceeds to ST20 to effect reversing control.

If no left-hand end detecting signal is detected at ST13, the microprocessor 60 checks at ST14 whether or not a timing signal (position signal) from the position detecting sensor 17 has been detected. If NO, the process returns to ST13, whereas, if YES, the process shifts to constant-speed control. That is, the microprocessor 60 saves the measured value T of the timer circuit 63 at ST15 and restarts the timer circuit 63 at ST16 to commence measuring the interval of the position signal.

At ST17, the microprocessor 60 compares the measured interval value T of the saved position signal with the constant-speed reference interval value Tref. If $T \geqq Tref$, the speed is judged to be lower than the reference speed. Therefore, a leftward driving signal is output at ST18 to accelerate the shuttle units 10 and 20. If $T < Tref$, the speed is judged to be higher than the reference speed. Therefore, a rightward driving signal is output at ST19 to decelerate the shuttle units 10 and 20. Then, the process returns to ST13.

When the microprocessor 60 detects a left-hand end detecting signal at ST13, it turns on the reversing driving signal at ST20 to drive the reversing motor parts so as to reverse the shuttle units 10 and 20. As shown in FIG. 10, the microprocessor 60 checks again at ST21 whether or not a left-hand end detecting signal has been detected. If NO, the print shuttle unit 10 is judged to be within the reversing region. Accordingly, the process is repeated from ST20 to continue the reversing driving signal on. When a left-hand end detecting signal is detected, it is judged that the print shuttle unit 10 has got out of the reversing region. Therefore, the reversing driving signal is turned off at ST22, and the process returns to ST1 for rightward movement control.

In this way, the print shuttle unit 10 and the balance shuttle unit 20 are synchronously driven by a common signal in each of the reversing timing control and constant-speed control operations by a single controller 6 on the basis of the position signal of the print shuttle unit 10.

Thus, the arrangement of the controller 6 is simplified. Further, since only the position detecting sensor 17 for the print shuttle unit 10 suffices for the control operation, it is possible to realize simplification of the arrangement.

Figure 13:
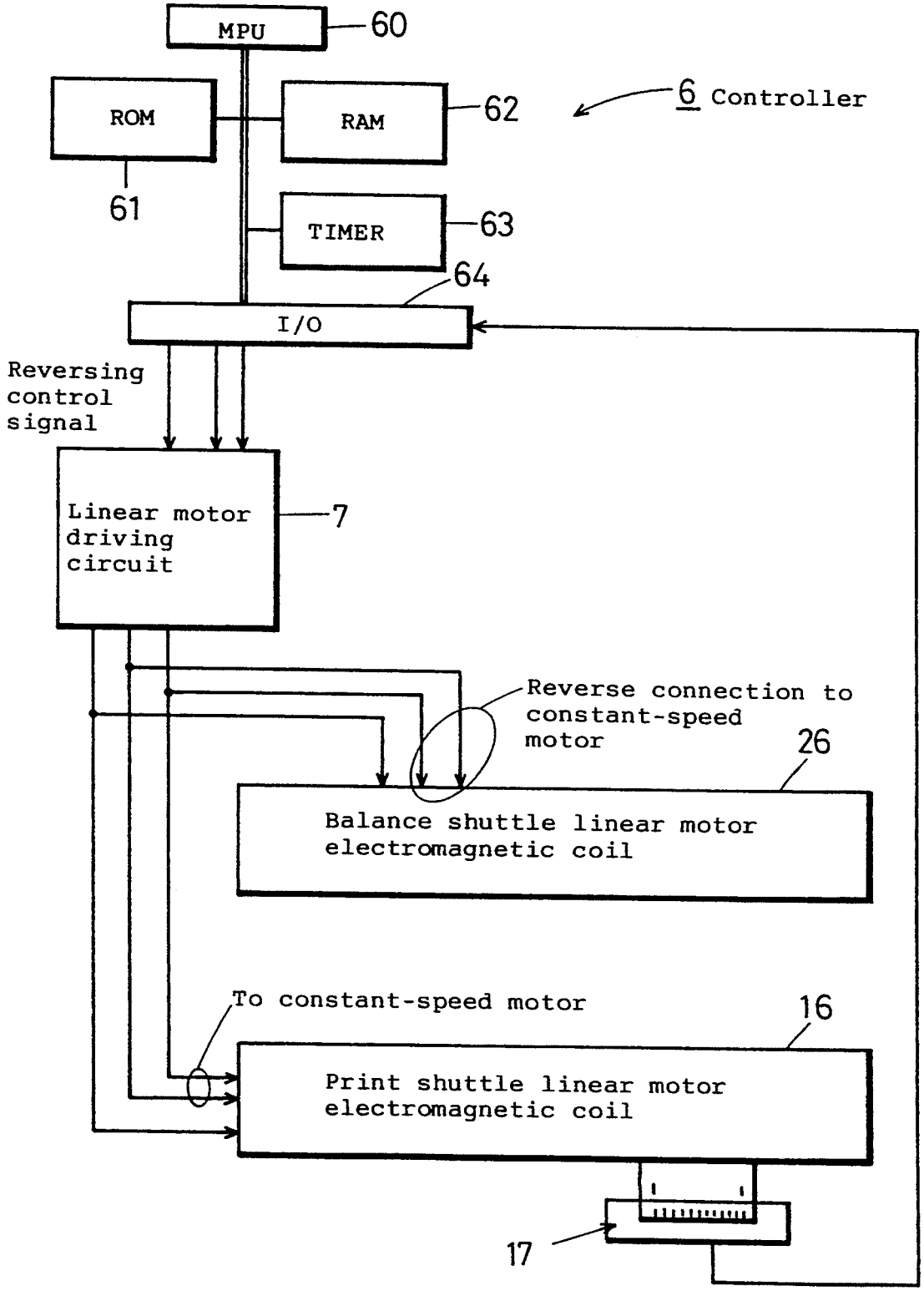
FIG. 13 is a circuit block diagram of a second embodiment of the present invention.

FIG. 13 shows the arrangement of the controller 6 in a second embodiment of the present invention.

In the figure, the same constituent elements as those shown in FIG. 7 are denoted by the same reference numerals. A linear motor driving circuit 7 is arranged to drive both the electromagnetic coils 16 of the linear motor for the print shuttle unit 10 and the electromagnetic coils 26 of the linear motor for the balance shuttle unit 20. In the balance shuttle unit 20, the constant-speed motor part of the second linear motor is opposite in polarity to that of the first linear motor in the print shuttle unit 10. The linear motor driving circuit 7 comprises the circuits shown in FIGS. 8 and 9.

In comparison to the first embodiment, shown in FIG. 7, this embodiment has a single motor driving circuit shared by the print shuttle unit 10 and the balance shuttle unit 20 and hence enables the arrangement to be even more simplified.

The other portions of this embodiment are the same as those of the first embodiment, shown in FIG. 7. In this embodiment also, the control processing shown in FIG. 12 is executed.

Figure 14:
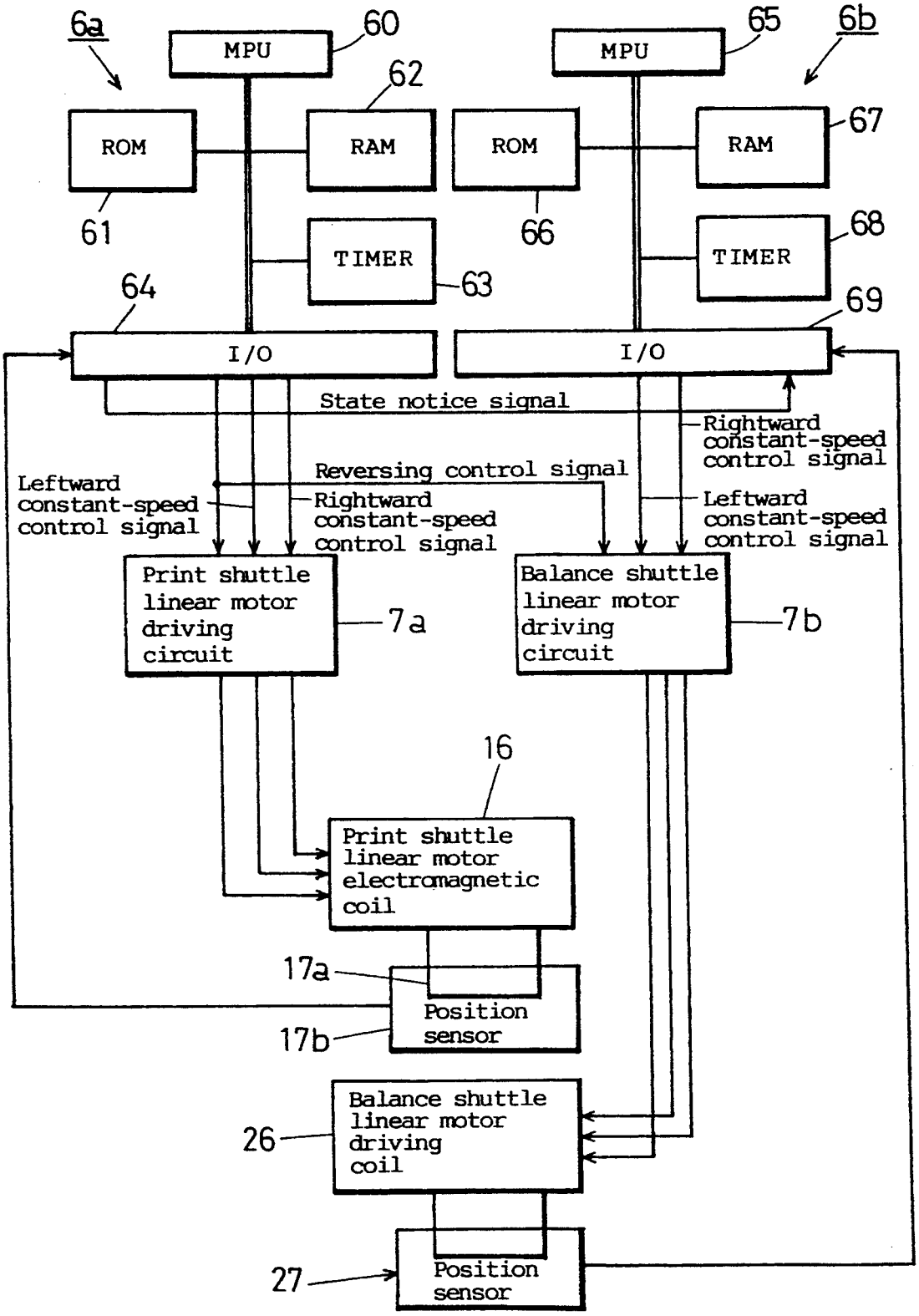
FIG. 14 is a circuit block diagram of a third embodiment of the present invention.

FIG. 14 shows the arrangement of a control part in a third embodiment of the present invention.

A first controller **6*a* has a microprocessor 60, a ROM 61 for storing a program, a RAM 62 for work, a timer circuit 63, and an I/O port 64 which receives an output signal from the position detecting sensor 17** and outputs a reversing control signal, a leftward constant-speed control signal, a rightward constant-speed control signal and a state notice signal.

A second controller **6*b* has a microprocessor 65, a ROM 66 for storing a program, a RAM 67 for work, a timer circuit 68, and an I/O port 69 which receives an output signal from the position detecting sensor 27** and the state notice signal and outputs a leftward constant-speed control signal and a rightward constant-speed control signal.

A print shuttle unit linear motor driving circuit **7*a* drives the electromagnetic coils 16 of the linear motor for the print shuttle unit 10 in response to the output of the controller 6*a*. A balance shuttle unit linear motor driving circuit 7*b* drives the electromagnetic coils 26 of the linear motor for the balance shuttle unit 20 on the basis of the reversing control signal from the controller 6*a* and the leftward and rightward constant-speed control signals from the controller 6*b***.

In this embodiment, reversing control for the print shuttle unit 10 and the balance shuttle unit 20 is effected by the first controller **6*a* on the basis of the output of the position detecting sensor 17, whereas constant-speed control for the two shuttle units 10 and 20 is effected by the respective controllers 6*a* and 6*b* on the basis of the outputs of the position detecting sensors 17 and 27, which are associated with the shuttle units 10 and 20**, respectively.

To obtain reversing synchronism between the first and second controllers **6*a* and 6*b*, the state notice signal is output from the controller 6*a* to the controller 6*b***.

Figure 15:
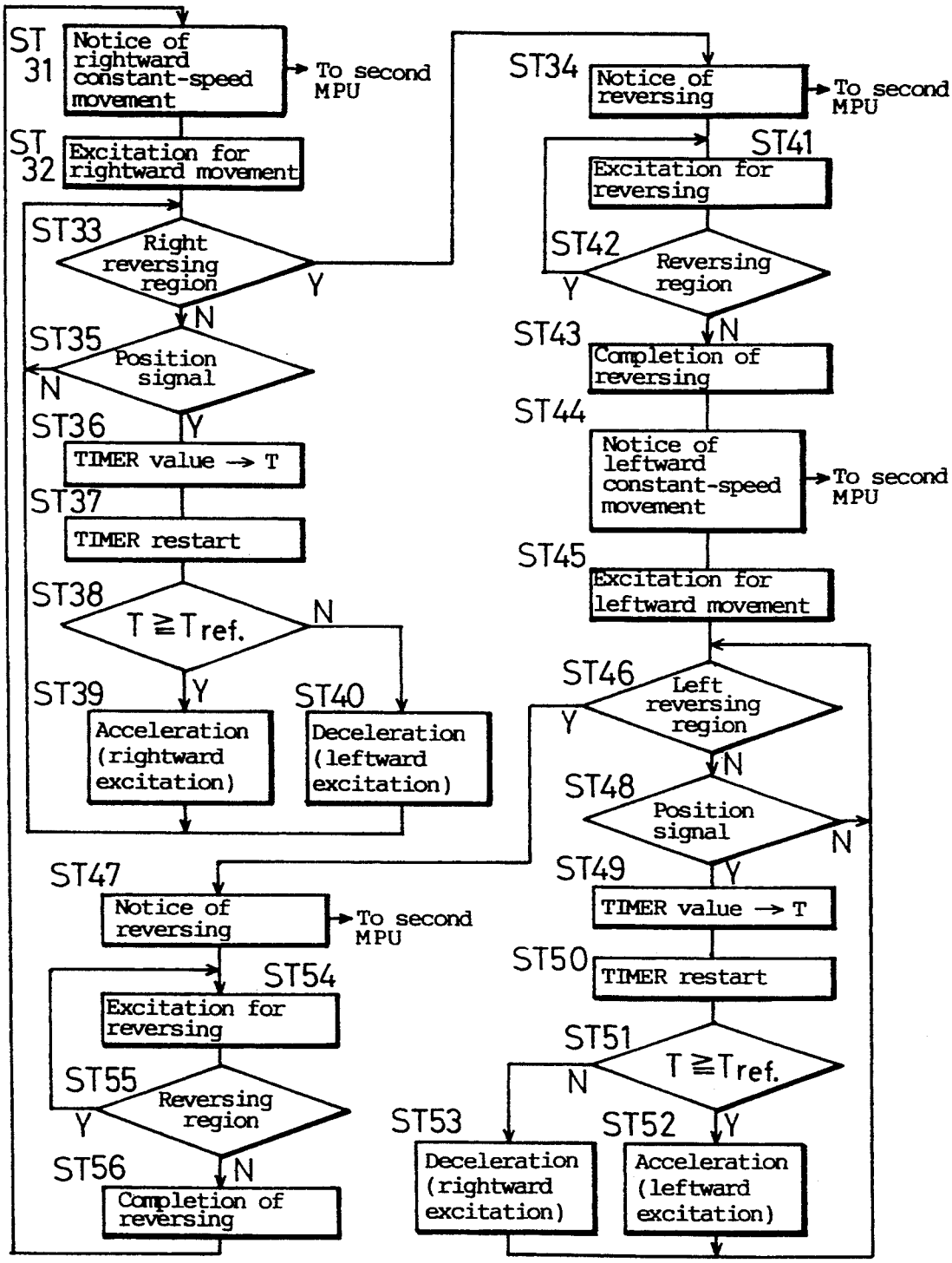
FIG. 15 is a flowchart showing control processing in the third embodiment of the present invention.

FIG. 15 is a flowchart of control processing in the third embodiment, showing the flow of control executed by the first controller **6*a***.

Before starting rightward movement, the first microprocessor 60 outputs notice of rightward constant-speed control to the second microprocessor 65 at ST31, and outputs a rightward driving signal through the I/O port 64 at ST32 to drive the electromagnetic coils 16 of the first linear motor through the driving circuits **7*a* and 7*b*, thereby moving the print shuttle unit 10** rightward.

Next, the first microprocessor 60 checks at ST33 whether or not a right-hand end detecting signal, which represents detection of the right-hand end slit, has been output from the position detecting sensor 17. If YES, the process proceeds to ST34 to effect reversing control.

If no right-hand end detecting signal is detected at ST33, the first microprocessor 60 checks at ST35 whether or not a timing signal (position signal) from the position detecting sensor 17 has been detected. If NO, the process returns to ST33, whereas, if YES, the process shifts to constant-speed control. That is, the first microprocessor 60 saves the measured value T of the timer circuit 63 at ST36 and restarts the timer circuit 63 at ST37 to commence measuring the interval of the position signal.

At ST38, the first microprocessor 60 compares the measured interval value T of the saved position signal with a constant-speed reference interval value Tref. If $T \geqq Tref$, the speed is judged to be lower than the reference speed. Therefore, a rightward driving signal is output at ST39 to accelerate the shuttle unit 10. If $T < Tref$, the speed is judged to be higher than the reference speed. Therefore, a leftward driving signal is output at ST40 to decelerate the shuttle unit 10. Then, the process returns to ST33.

When the first microprocessor 60 detects a right-hand end detecting signal at ST33, reversing control is commenced. That is, the first microprocessor 60 first outputs notice of reversing to the second microprocessor 65 at ST34, and turns on the reversing driving signal at ST41 to drive the reversing motor part so as to reverse the shuttle unit 10. As shown in FIG. 10, the first microprocessor 60 checks again at ST42 whether or not a right-hand end detecting signal has been detected. If NO, the print shuttle unit 10 is judged to be within the reversing region. Accordingly, the process is repeated from ST41 to continue the reversing driving signal on. When a right-hand end detecting signal is detected, it is judged that the print shuttle unit 10 has got out of the reversing region. Therefore, the reversing driving signal is turned off at ST43, and the process proceeds to ST44 to effect leftward movement control.

To perform leftward constant-speed control, the first microprocessor 60 outputs notice of leftward constant-speed control to the second microprocessor 65 at ST44, and outputs a leftward driving signal from the I/O port 64 at ST45 to drive the electromagnetic coils 16 of the first linear motor through the driving circuit 7*a*, thereby moving the print shuttle unit 10 leftward.

Subsequently, the first microprocessor 60 checks at ST46 whether or not a left-hand end detecting signal, which represents detection of the left-hand end slit, has been output from the position detecting sensor 17. If YES, the process proceeds to ST47 to effect reversing control.

If no left-hand end detecting signal is detected at ST46, the first microprocessor 60 checks at ST48 whether or not a timing signal (position signal) from the position detecting sensor 17 has been detected. If NO, the process returns to ST46, whereas, if YES, the process shifts to constant-speed control. That is, the first microprocessor 60 saves the measured value T of the timer circuit 63 at ST49 and restarts the timer circuit 63 at ST50 to commence measuring the interval of the position signal.

At ST51, the first microprocessor 60 compares the measured interval value T of the saved position signal with the constant-speed reference interval value Tref. If $T \geqq Tref$, the speed is judged to be lower than the reference speed. Therefore, a leftward driving signal is output at ST52 to accelerate the shuttle unit 10. If $T < Tref$, the speed is judged to be higher than the reference speed. Therefore, a rightward driving signal is output at ST53 to decelerate the shuttle unit 10. Then, the process returns to ST46.

When the first microprocessor 60 detects a left-hand end detecting signal at ST46, it commences reversing control. That is, the first microprocessor 60 first outputs notice of reversing to the second microprocessor 65 at ST47 and then turns on the reversing driving signal at ST54 to drive the reversing motor part so as to reverse the shuttle unit 10. As shown in FIG. 10, the first microprocessor 60 checks again at ST55 whether or not a left-hand end detecting signal has been detected. If NO, the print shuttle unit 10 is judged to be within the reversing region. Accordingly, the process is repeated from ST54 to continue the reversing driving signal on. When a left-hand end detecting signal is detected, it is judged that the print shuttle unit 10 has got out of the reversing region. Therefore, the reversing driving signal is turned off at ST56, and the process returns to ST31 for rightward movement control.

Figure 16:
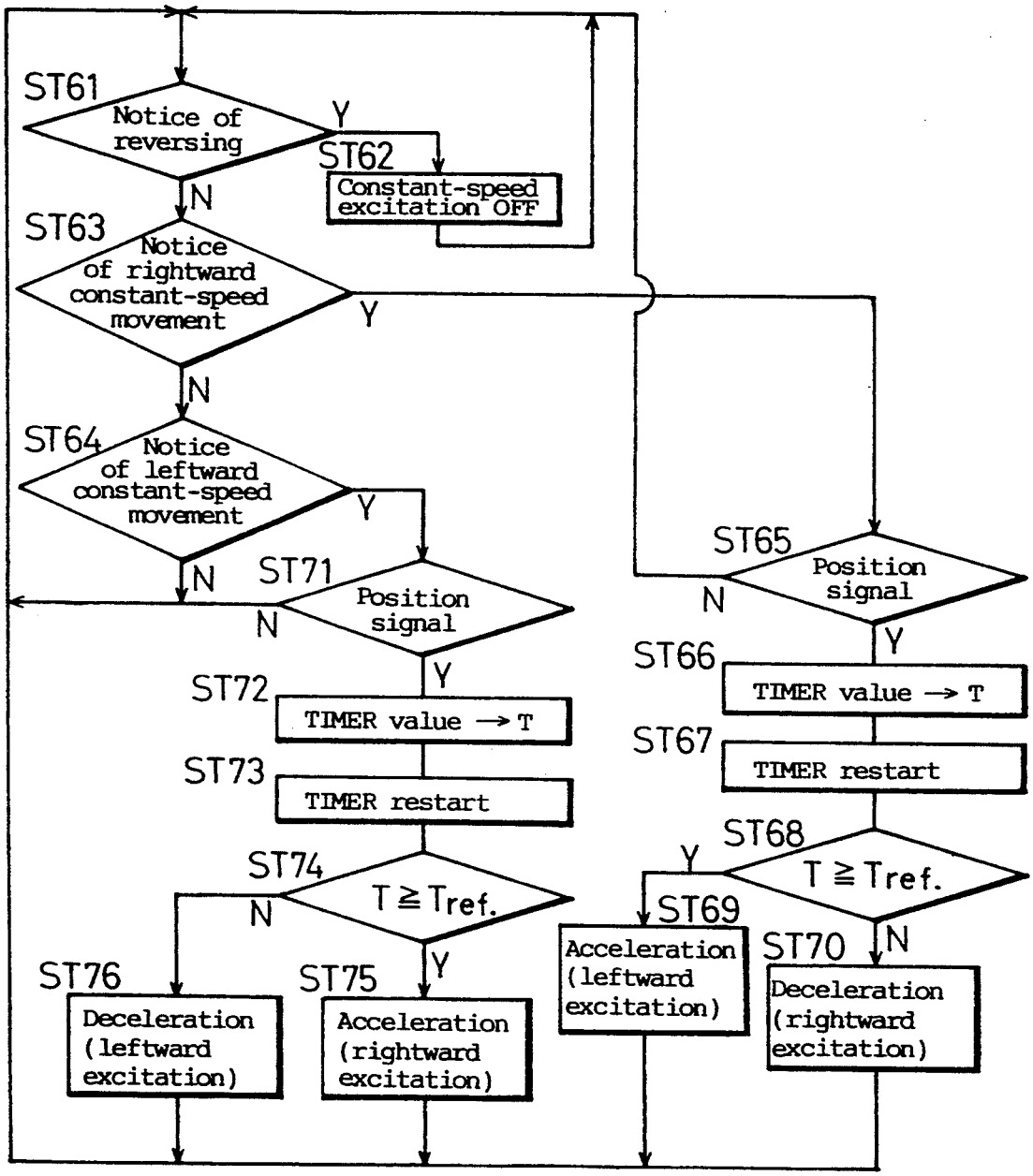
FIG. 16 is a flowchart showing control processing in the third embodiment of the present invention.

FIG. 16 shows the constant-speed control flow executed by the second controller 6*b* of the third embodiment.

The second microprocessor 65 checks at ST61 whether or not notice of reversing has been output from the first microprocessor 60.

If notice of reversing is received, the balance shuttle unit 20 is subjected to reversing control by the reversing driving signal from the first controller 6*a*. Therefore, the driving signal for the constant-speed control of the balance shuttle unit 20 is turned off at ST62, and the process returns to ST61.

If it is judged that no notice of reversing has yet been output from the first microprocessor 60, the second microprocessor 65 checks at ST63 whether or not notice of rightward constant-speed control has been output from the first microprocessor 60. If NO, the process proceeds to ST64.

If it is judged that notice of rightward constant-speed control has been output from the first microprocessor 60, the second microprocessor 65 commences drive in a direction reverse to the rightward direction, that is, leftward drive, at ST65.

More specifically, the second microprocessor 65 checks at ST65 whether or not a timing signal (position signal) from the second position detecting sensor 27 has been detected. If NO, the process returns to ST61, whereas, if YES, the process shifts to leftward constant-speed control. That is, the second microprocessor 65 saves the measured value T of the second timer circuit 68 at ST66 and restarts the timer circuit 68 at ST67 to commence measuring the interval of the position signal.

At ST68, the second microprocessor 65 compares the measured interval value T of the saved position signal with the constant-speed reference interval value Tref. If $T \geqq Tref$, the speed is judged to be lower than the reference speed. Therefore, a leftward driving signal is output at ST69 to accelerate the shuttle unit 20. If $T < Tref$, the speed is judged to be higher than the reference speed. Therefore, a rightward driving signal is output at ST70 to decelerate the shuttle unit 20. Then, the process returns to ST61.

If it is judged at ST63 that no notice of rightward constant-speed control has yet been output from the first microprocessor 60, the second microprocessor 65 checks at ST64 whether or not notice of leftward constant-speed control has been output from the first microprocessor 60. If NO, the process returns to ST61.

If it is judged ST64 that notice of leftward constant-speed control has been output from the first microprocessor 60, the second microprocessor 65 commences drive in a direction reverse to the leftward direction, that is, rightward drive.

More specifically, the second microprocessor 65 checks at ST71 whether or not a timing signal (position signal) from the second position detecting sensor 27 has been detected. If NO, the process returns to ST61, whereas, if YES, the process shifts to rightward constant-speed control. That is, the second microprocessor 65 saves the measured value T of the second timer circuit 68 at ST72 and restarts the timer circuit 68 at ST73 to commence measuring the interval of the position signal.

At ST74, the second microprocessor 65 compares the measured interval value T of the saved position signal with the constant-speed reference interval value Tref. If T≧Tref, the speed is judged to be lower than the reference speed. Therefore, a rightward driving signal is output at ST75 to accelerate the shuttle unit 20. If T<-Tref, the speed is judged to be higher than the reference speed. Therefore, a leftward driving signal is output at ST76 to decelerate the shuttle unit 20. Then, the process returns to ST61.

If constant-speed control is effected by a single driving signal as in the first embodiment, when the speed of the print shuttle unit 10 lowers due to the influence of disturbance, the print shuttle unit 10 is accelerated, and the speed of the balance shuttle unit 20, which is driven at a speed equal to that of the print shuttle unit 10, becomes higher than the reference speed because the balance shuttle unit 20 is not affected by the disturbance. Thus, there is a possibility that the balance shuttle unit 20 will overrun.

In contrast, in this embodiment a common driving signal is used only for the reversing control of the first and second linear motors, and the constant-speed control is independently carried out. Therefore, even if the print shuttle unit 10 is accelerated to compensate for a lowering in the speed due to the influence of disturbance, the balance shuttle unit 20 can be maintained at a constant speed. Accordingly, it is possible to eliminate likelihood of overrun.

In addition, since in this embodiment the control processing is distributively executed by two controllers (processors), it is possible to realize the desired control by using inexpensive processors, e.g., 8-bit processors.

Figure 17:
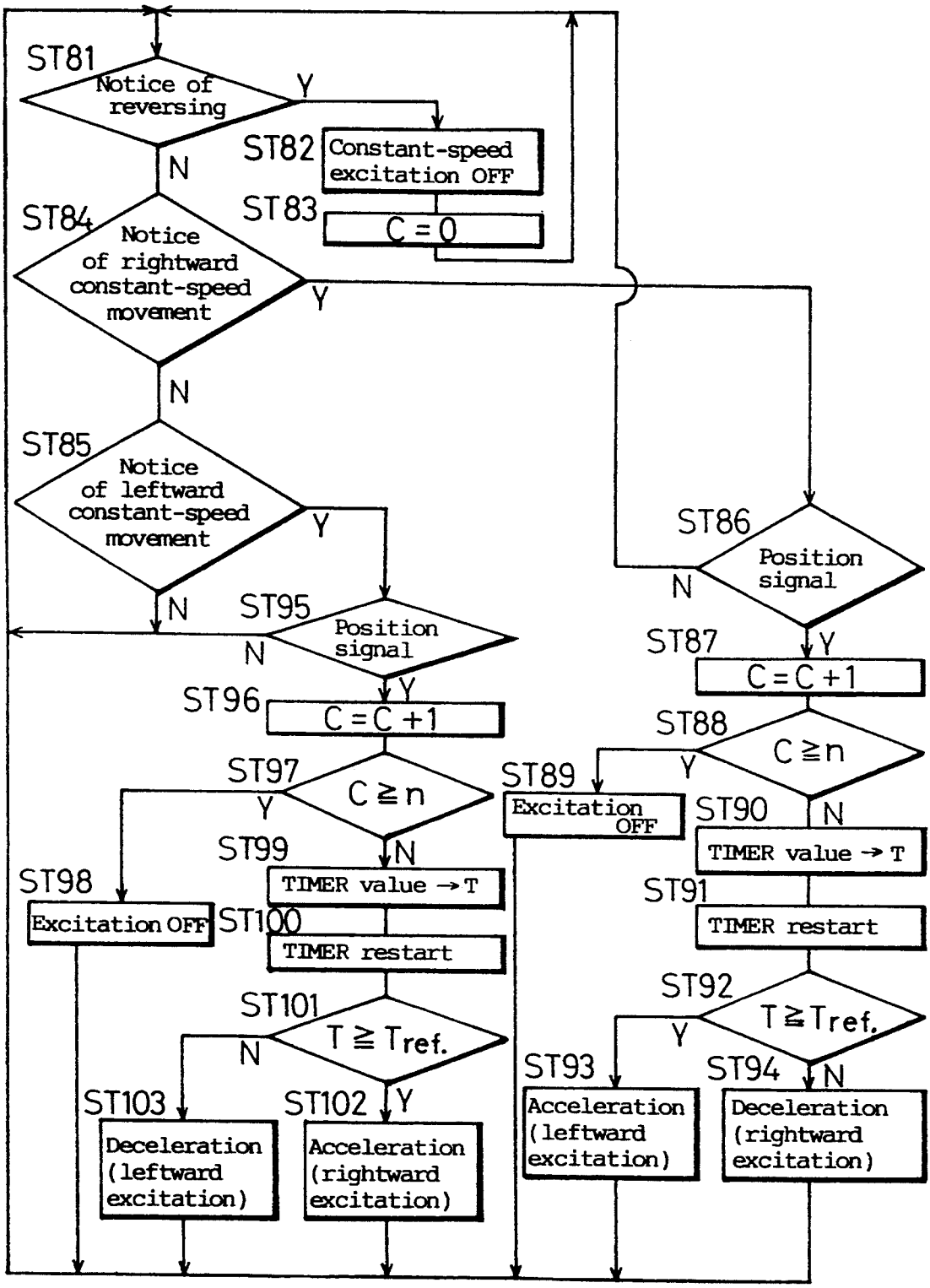
FIG. 17 is a flowchart showing control processing in a fourth embodiment of the present invention.

FIG. 17 is a flowchart of control processing in a fourth embodiment of the present invention, showing processing executed by the second microprocessor 65.

The arrangement of this embodiment is the same as that of the third embodiment, which is shown in FIG. 14. The processing executed by the first microprocessor 60 is the same as that shown in FIG. 15. In this embodiment, position detection for the balance shuttle unit 20 is carried out to prevent overrun positively.

The second microprocessor 65 checks at ST81 whether or not notice of reversing has been output from the first microprocessor 60.

If YES, the balance shuttle unit 20 is subjected to reversing control by the reversing driving signal from the first controller 6a. Therefore, the second microprocessor 65 turns off the driving signal for constant-speed control at ST82, and resets the position counter C to "0" at ST83. Then, the process returns to ST81.

If it is judged at ST81 that no notice of reversing has yet been output from the first microprocessor 60, the second microprocessor 65 checks at ST84 whether or not notice of rightward constant-speed control has been output from the first microprocessor 60. If NO, the process proceeds to ST85.

If it is judged at ST84 that notice of rightward constant-speed control has been output from the first microprocessor 60, the second microprocessor 65 commences drive in a direction reverse to the rightward direction, i.e., leftward drive.

More specifically, the second microprocessor 65 checks at ST86 whether or not a timing signal (position signal) from the second position detecting sensor 27 has been detected. If NO, the process returns to ST81, whereas, if YES, the second microprocessor 65 updates the position counter C to C+1 at ST87 and compares the value of the counter C with a set travel distance n. If the value of the position counter C is not less than n, it is judged that the balance shuttle unit 20 has moved the set travel distance or more. Accordingly, the second microprocessor 65 stops the movement of the balance shuttle unit 20 at ST89 and returns to ST81.

Conversely, if the value of the position counter C is less than n, it is judged that the balance shuttle unit 20 has not yet moved the set travel distance. Accordingly, the process shifts to leftward constant-speed control. That is, the second microprocessor 65 saves the measured value T of the second timer circuit 68 at ST90 and restarts the second timer circuit 68 at ST91 to commence measuring the interval of the position signal.

At ST92, the second microprocessor 65 compares the measured interval value T of the saved position signal with the constant-speed reference interval value Tref. If T≧Tref, the speed is judged to be lower than the reference speed. Therefore, a leftward driving signal is output at ST93 to accelerate the shuttle unit 20. If T<Tref, the speed is judged to be higher than the reference speed. Therefore, a rightward driving signal is output at ST94 to decelerate the shuttle unit 20. Then, the process returns to ST81.

If it is judged at ST84 that no notice of rightward constant-speed control has yet been output from the first microprocessor 60, the second microprocessor 65 checks at ST85 whether or not notice of leftward constant-speed control has been output from the first microprocessor 60. If NO, the process returns to ST81.

If it is judged at ST85 that notice of leftward constant-speed control has been output from the first microprocessor 60, the second microprocessor 65 commences drive in a direction reverse to the leftward direction, that is, rightward drive.

More specifically, the second microprocessor 65 checks at ST95 whether or not a timing signal (position signal) from the second position detecting sensor 27 has been detected. If NO, the process returns to ST81, whereas, if YES, the second microprocessor 65 updates the position counter C to C+1 at ST96 and compares the value of the counter C with the set travel distance n at ST97. If the value of the position counter C is not less than n, it is judged that the balance shuttle unit 20 has moved the set travel distance or more. Accordingly, the second microprocessor 65 stops the movement of the balance shuttle unit 20 at ST98 and returns to ST81.

Conversely, if the value of the position counter C is less than n, it is judged that the balance shuttle unit 20 has not yet moved the set travel distance. Accordingly, the process shifts to rightward constant-speed control. That is, the second microprocessor 65 saves the measured value T of the second timer circuit 68 at ST99 and restarts the timer circuit 68 at ST100 to commence measuring the interval of the position signal.

At ST101, the second microprocessor 65 compares the measured interval value T of the saved position signal with the constant-speed reference interval value Tref. If T≧Tref, the speed is judged to be lower than the reference speed. Therefore, a rightward driving signal is output at ST102 to accelerate the shuttle unit 20. If T<Tref, the speed is judged to be higher than the reference speed. Therefore, a leftward driving signal is output at ST103 to decelerate the shuttle unit 20. Then, the process returns to ST81.

By virtue of the above-described arrangement, even if the balance shuttle unit 20 is moved at an excessively high speed because the movement of the print shuttle unit 10 is retarded by interference with the drive, which may be caused, for example, when the user's hand touches the print shuttle unit 10 during the movement, the balance shuttle unit 20 can be prevented from overrunning and colliding with the frame or other stationary member.

In addition to the foregoing embodiments, the present invention includes modifications such as those described below:

Although in the foregoing embodiments the print head is a wire dot-matrix print head, the present invention may also be applied to other dot print heads, e.g., an ink jet print head.

Although in the third embodiment two controllers are provided, if a high-speed processor is used, constant-speed control of the two shuttles can be effected with a single controller by time sharing control.

Although in the foregoing description the driving devices are linear motors, other actuators, e.g., DC motors, can also be used.

According to the present invention, since a driving device is also provided for the balance shuttle, it is unnecessary to use a large-output driving device for the print shuttle. Therefore, it is possible to reduce the overall size of the printer and to lower the production cost thereof.

Further, since the two driving devices are electrically connected to each other and synchronously controlled, it is possible to prevent the two shuttles from operating asynchronously.

While the invention has been described by reference to specific embodiments chosen for purposes of illustration, it should be apparent that numerous modifications could be made thereto by those skilled in the art without departing from the basic concept and scope of the invention.

We claim:

1. A shuttle printer having a print shuttle unit capable of reciprocating with a print head mounted thereon, and a balance shuttle unit capable of reciprocating to generate counterforce to momentum of said print shuttle unit, said shuttle printer comprising:

means for driving said print shuttle unit to reciprocate;

means for driving said balance shuttle unit to reciprocate;

means for detecting a position of said print shuttle unit; and means for synchronously controlling said two driving means in response to a result of detection by said print shuttle unit position detecting means.

2. A shuttle printer according to claim 1, which is a line printer wherein said print shuttle unit has a plurality of print heads provided thereon in a horizontal row.

3. A shuttle printer according to claim 1, wherein said two driving means are linear motors.

4. A shuttle printer according to claim 3, wherein said control means controls current passed through electromagnetic coils of said two linear motors.

5. A shuttle printer according to claim 1, wherein said print shuttle unit position detecting means has a slit formed in said print shuttle unit and a photosensor provided on a stationary member so as to face said slit.

6. A shuttle printer according to claim 1, wherein said control means synchronously controls said two driving means in each of reversing timing control and constant-speed control.

7. A shuttle printer according to claim 6, wherein said two driving means are linear motors, each of said linear motors having electromagnetic coils divided into two groups respectively functioning as a constant-speed motor part and a reversing motor part, said constant-speed motor parts of said two driving means being opposite in polarity to each other.

8. A shuttle printer according to claim 1, further comprising means for detecting a position of said balance shuttle unit, wherein said control means controls reversing timing of said two driving means synchronously with each other and effects constant-speed control of said two driving means independently of each other.

9. A shuttle printer according to claim 8, wherein said control means stops drive of said balance shuttle unit driving means when overrun of said balance shuttle unit is detected on the basis of an output of said balance shuttle unit position detecting means.

10. A shuttle printer having a print shuttle unit capable of reciprocating with a print head mounted thereon, and a balance shuttle unit capable of reciprocating to generate counterforce to momentum of said print shuttle unit, said shuttle printer comprising:

first means for driving said print shuttle unit to reciprocate and including a first driving circuit; and second means for driving said balance shuttle unit to reciprocate and including a second driving circuit;

said second driving circuit being connected in said second driving means such that a polarity thereof is opposite to that of said first driving circuit.

11. A shuttle printer according to claim 10, wherein said first and second driving circuits are two separate driving circuit units.

12. A shuttle printer according to claim 10, wherein said first and second driving circuits are incorporated in a single driving circuit unit.

13. A shuttle printer according to claim 10, wherein said first driving means and said second driving means is each of the same configuration and each including electromagnetic coils and permanent magnets, said first and second driving circuits being connected to respective electromagnetic coils of said first and second driving means.

14. A shuttle printer according to claim 10, which is a line printer wherein said print shuttle unit has a plurality of print heads provided thereon in a horizontal row.

15. A shuttle printer according to claim 10, wherein said first and second driving means are linear motors.

16. A shuttle printer according to claim 10, further comprising means for detecting a position of said balance shuttle unit, and control means for controlling reversing timing of said first and second driving means synchronously with each other and effecting constant-speed control of said first and second driving means independently of each other.

17. A shuttle printer according to claim 16, wherein said control means stops drive of said second driving means when overrun of said balance shuttle unit is detected on the basis of an output of said detecting means.

18. A shuttle printer having a print shuttle unit capable of reciprocating with a print head mounted thereon, and a balance shuttle unit capable of reciprocating to generate counterforce to momentum of said print shuttle unit, said shuttle printer comprising:

first means for driving said print shuttle unit to reciprocate and including a first driving circuit;

second means for driving said balance shuttle unit to reciprocate and including a second driving circuit;

said second driving circuit being connected in said second driving means such that a polarity thereof is opposite to that of said first driving circuit;

means for detecting a position of said print shuttle unit; and means for synchronously controlling said first and second driving means in response to a result of detection by said detecting means.

19. A shuttle printer according to claim 18, which is a line printer wherein said print shuttle unit has a plurality of print heads provided thereon in a horizontal row.

20. A shuttle printer according to claim 18, wherein said first and second driving means are linear motors.

21. A shuttle printer according to claim 20, wherein said controlling means controls current passed through electromagnetic coils of said two linear motors.

22. A shuttle printer according to claim 18, wherein said detecting means has a slit formed in said print shuttle unit and a photosensor provided on a stationary member so as to face said slit.

23. A shuttle printer according to claim 18, wherein said controlling means synchronously controls said first and second driving means in each of reversing timing control and constant-speed control.

24. A shuttle printer according to claim 23, wherein said first and second driving means are linear motors, each of said linear motors having electromagnetic coils divided into two groups respectively functioning as a constant-speed motor part and a reversing motor part, said constant-speed motor parts of said first and second driving means being opposite in polarity to each other.

25. A shuttle printer according to claim 18, wherein said controlling means controls reversing timing of said first and second driving means synchronously with each other and effects constant-speed control of said first and second driving means independently of each other.

26. A shuttle printer according to claim 25, wherein said controlling means stops drive of said second driving means when overrun of said balance shuttle unit is detected on the basis of an output of said detecting means.

* * * * *